US005211594A

United States Patent [19]

Barrows

[11] Patent Number: 5,211,594

[45] Date of Patent: May 18, 1993

[54] WATER SKI HYDROFOIL AND PROCESS

[76] Inventor: Michael L. Barrows, 59 Robinson Dr., Newport News, Va. 23601

[21] Appl. No.: 907,860

[22] Filed: Jul. 2, 1992

[51] Int. Cl.[5] ..... B63B 21/00

[52] U.S. Cl. ..... 441/79; 441/65; 428/71; D12/309; 114/274

[58] Field of Search ..... 114/39.2, 274, 253, 114/283, 93; 441/69, 73, 74, 79, 65; D12/309; 264/136, 137, 257; 156/245; 428/68, 71, 319.1, 319.7, 116, 117, 250, 263, 382

[56] References Cited

U.S. PATENT DOCUMENTS

| | | | |
|---|---|---|---|
| 2,956,281 | 10/1960 | McMillan | 428/117 |
| 3,902,732 | 9/1975 | Fosha | 428/116 |
| 5,007,871 | 4/1991 | Dyer | 441/79 |
| 5,063,869 | 11/1991 | Bielefeldt | 114/283 |
| 5,100,354 | 3/1992 | Woolley | 114/274 |

*Primary Examiner*—Sherman Basinger

*Assistant Examiner*—Clifford T. Bartz

*Attorney, Agent, or Firm*—Wallace J. Nelson

[57] ABSTRACT

A lightweight, high strength, water ski hydrofoil assembly includes a diamond planform hydrofoil wing and a V-strut connecting the wing to a parallel ski support platform. The diamond planform wing is formed as a unit and the separately formed V-strut and platform secured thereto. The wing is provided with a foam plastic, aluminum or composite core element, while the V-strut and platform are provided with core elements selected from aluminum or aluminum alloys, composites and balsa wood. In the preferred embodiment, the core elements are provided with an intermediate layer of molded composite material (resin impregnated fiberglass and graphite fibers, or cloth) and an outer layer of rubber. The rubber coating may be applied to the core elements by injection molding, and confined to the leading and trailing edges of the components, with the intermediate layer being omitted, in some embodiments.

20 Claims, 5 Drawing Sheets

WATER SKI HYDROFOIL AND PROCESS

FIELD OF THE INVENTION

This invention relates generally to water skis and relates particularly to an improved water ski hydrofoil assembly and process of making same.

BACKGROUND OF THE INVENTION

Water skiing has become one of the faborite aquatic sports in the United States and other countries and is now enjoyed by thousands, if not millions. The addition of hydrofoils to water skis enables the user to achieve greater maneuverability, and a wider speed range, than that obtainable by conventional skis. Also, since hydrofoils create less drag than conventional water skis, the sport is no longer limited to high horse power and high speed boats but is open up to relatively low speed boats. Exemplary prior art water ski hydrofoils are described in U.S. Pat. Nos. 2,751,612 and 3,164,119.

Although water ski hydrofoils have previously been employed, these known systems are generally cumbersome, some have sharp metal, plastic and/or wooden edges and present a safety hazard. Also, these known systems are generally heavy and expensive to manufacture.

It is an object of the present invention to utilize the advantageous features of the prior art systems while minimizing the disadvantages thereof.

It is a further object of the present invention to provide an improved hydrofoil assembly for use with water skis.

Another object of the present invention is to provide a durable lightweight, hydrofoil assembly for use with water skis.

Another object of the present invention is a water ski hydrofoil assembly devoid of sharp, hazardous, edge surfaces.

Another object of the present invention is to provide a water ski hydrofoil assembly having shock absorbing, cushioning, rubber leading and trailing edge surface areas.

A further object of the present invention is a method of constructing a lightweight hydrofoil assembly.

An additional object of the present invention is a low drag, durable, lightweight, hydrofoil assembly having shock absorbing exterior surfaces.

SUMMARY OF THE INVENTION

According to the present invention the foregoing and additional objects are attained by providing a pair of connected triangular planform configured hydrofoil sections, disposed in parallel planes, facing in opposite directions, and having the spaced wing tips thereof provided with ninety degree vertical winglet sections extending therefrom. The winglets on one hydrofoil section are connected to the winglets on the oppositely facing hydrofoil section to form a unitary diamond planform hydrofoil structure.

An elongated spar or boom is integral with and extends between the apex of the triangular hydrofoil sections. In one aspect of the present invention, the entire diamond planform hydrofoil is molded as a single unit. In another aspect of the present invention, the diamond planform is formed of sheet aluminum and provided with an exterior coating of rubber via injection molding or similar process.

A pair of vertically extending struts are joined at one end thereof and disposed in a V-configuration. The bottom of the "V" is attached intermediate the rectangular spar. The other spaced ends of the V-configured struts connect with a base surface of a horizontal ski support platform. The horizontal ski support platform is provided with spaced ski receiving brackets on the top surface thereof. In the preferred embodiment, the pair of vertical struts and horizontal platform are molded as a unit. In an alternate embodiment the struts are formed as a unit and secured to a separately formed platform.

In the preferred embodiment of the present invention, the triangular planform sections of the hydrofoil are provided with a center core element formed of foam plastic. This core element is provided with one or more layers of prepreg material and placed in a mold having a sheet rubber liner disposed therein. Ends of the rubber liner and prepreg material are positioned to form the connecting winglet sections for the final diamond configured hydrofoil. The upper surface of the prepreg wrapped core is covered with additional rubber sheets and an upper mold cover assembled over the structure. The mold and contents are then heated at an elevated temperature to cure the prepreg and rubber into a unitary, molded, diamond planform, hydrofoil.

The struts and horizontal platform are molded as a unit in a similar fashion and attached to the center of the hydrofoil spar. The core of the struts and platform are formed of one or more elongated lengths of aluminum, aluminum alloy, composites, balsa wood, or a combination thereof. Alternately, the horizontal support platform and V-strut assembly may be molded separately, and from similar or different materials, and pinned together. Also, the horizontal platform may be machined from aluminum or aluminum alloy stock and then provided with a shock absorbing rubber coating prior to being attached to the spaced ends of the V-struts.

BRIEF DESCRIPTION OF THE DRAWINGS

A more complete appreciation of the invention and many of the attendant advantages thereof will become more readily apparent as the same becomes better understood by reference to the following detailed description when considered in connection with the accompanying drawings wherein.

DETAILED DESCRIPTION

Figure 1:
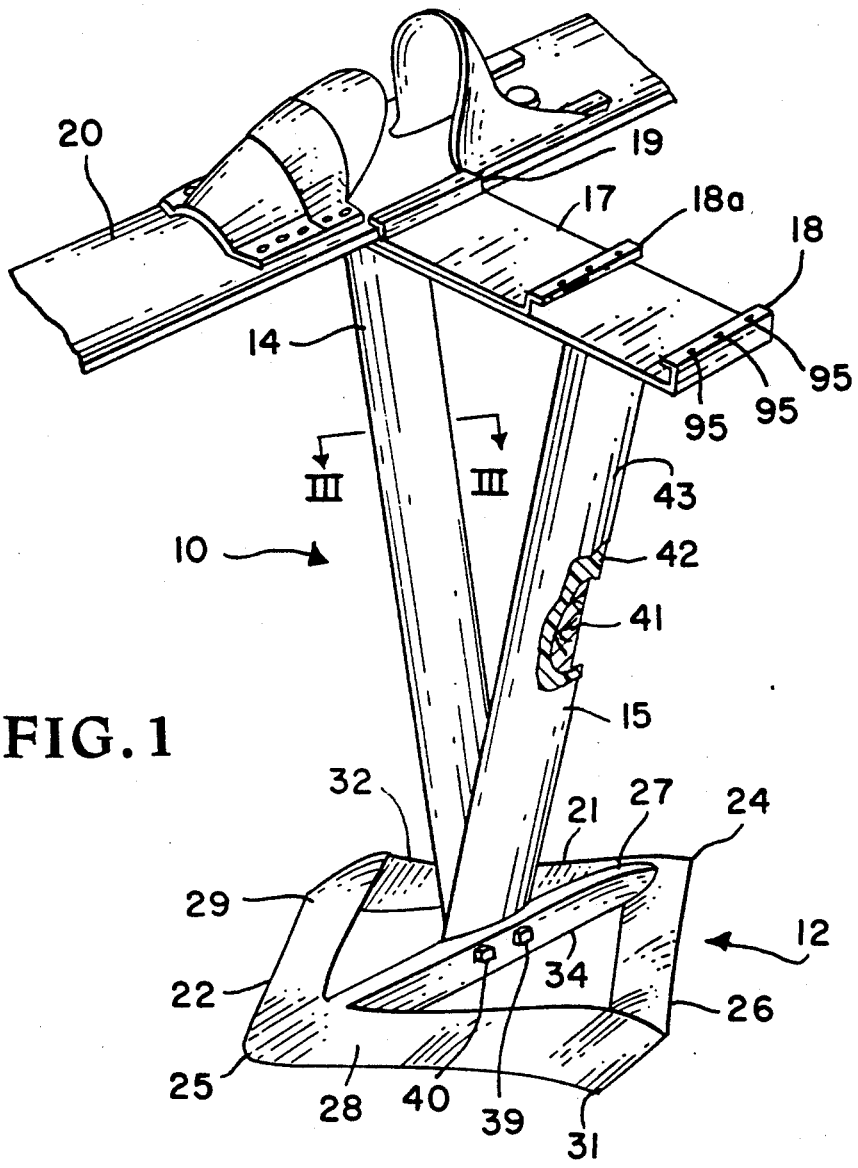
FIG. 1 is a schematic, perspective view of the hydrofoil assembly of the present invention with parts broken away and parts omitted.

Referring now to the drawings, and more particularly to FIG. 1, the water ski hydrofoil assembly, according to the present invention, is shown and designated generally by reference numeral 10. Hydrofoil assembly 10 is formed of three basic interconnected components, a hydrofoil or wing 12, a pair of struts 14,15 arranged in a V-configuration and attached at the base of the "V" to hydrofoil 12, and a ski support platform 17 disposed at the top or open end of the "V". Paired spaced ski support brackets 18,18*a* and 19,19*a* are attached to the top surface of ski support platform 17 at substantially the end portions thereof. Ski support bracket pairs 18,18*a* and 19,19*a* serve to, respectively, maintain a pair of conventional water skis 20,23 (FIG. 12) to hydrofoil assembly 10, and thereby provide center loading of a skier over hydrofoil wing 12. The open end of V-configured struts 14,15 are secured to the bottom surface of platform 17 opposite to, and at substantially the mid or center point of, respective ski support bracket pairs 18,18*a* and 19,19*a*. The base or closed end of V-struts 14,15 is secured to substantially the center of hydrofoil wing 12, as will be further explained hereinafter.

Figure 2:
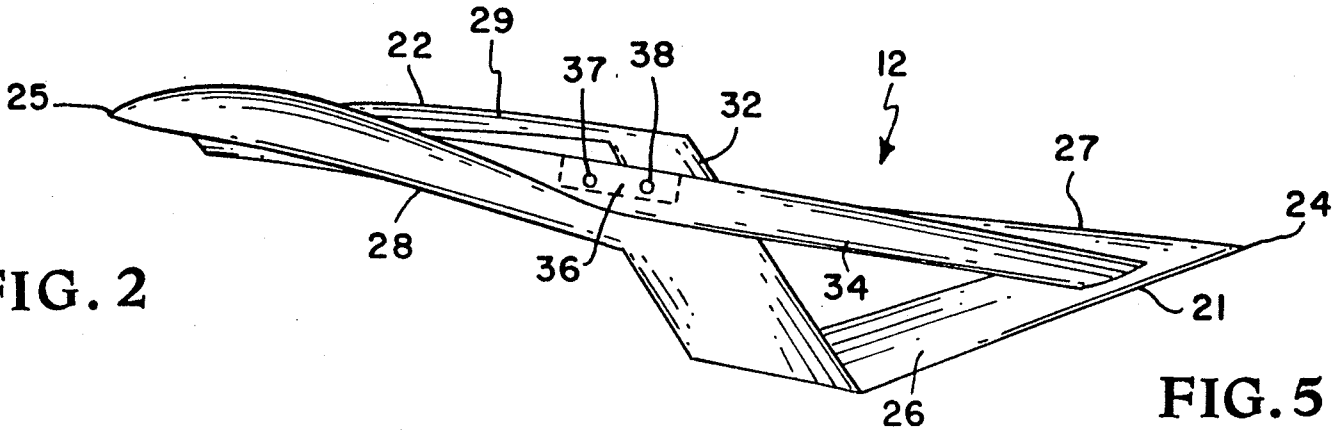
FIG. 2 is a schematic side view of the hydrofoil wing element shown in FIG. 1.

As illustrated in FIGS. 1 and 2, hydrofoil wing 12 is of a diamond planform and includes a pair of triangular planform hydrofoil sections, as designated by reference numerals 21,22. Triangular hydrofoil sections 21,22 are provided with respective apexes 24,25 each having a pair of wings integral therewith and trailing in a substantially forty-five degree angular spaced relationship therefrom. The wings trailing from apex 24 for triangular hydrofoil section 21 are designated by reference numerals 26,27, while the wings trailing from apex 25 for triangular hydrofoil section 22 are designated by reference numerals 28,29. The wing tips of wings 26,27 and wings 27,28 are each provided with a ninety degree vertical winglet section extending therefrom. As will be explained further hereinafter, in constructing hydrofoil wing 12, the mold sections for forming triangular planform hydrofoils 21,22 are disposed facing in opposite directions and in separate parallel planes such that the winglets formed on one hydrofoil abut, and mold integral with, the winglets on the other hydrofoil to thereby form interconnecting winglets 31,32 for hydrofoil 12.

An elongated, essentially rectangular, spar or boom 34 extends between, and is integrally molded to, the respective apexes 24,25 of hydrofoil sections 21,22. Spar 34 is provided with a centrally located rectangular slot at substantially the intermediate upper surface thereof, as shown in dotted line and designed by reference numeral 36 (FIG. 2). A pair of transverse countersunk bores 37,38 extend through spar 34 and serve to receive a pair of spring pins or bolts 39,40 (FIG. 1) to connect with, and attach the base of V-struts 14,15 to, hydrofoil wing 12.

Figure 3:
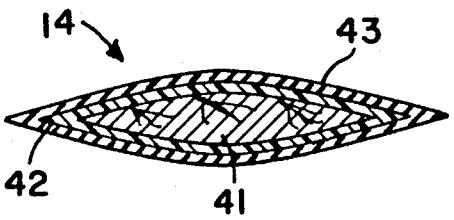
FIG. 3 is a sectional view of one of the struts as seen along line III—III of FIG. 1.

At least the leading and trailing edges, and in the embodiment illustrated in FIGS. 1 and 2, the entire exposed surface area of struts 14 and 15, hydrofoil 12, and platform 17, are formed of rubber. An exemplary construction for strut 14 (and strut 15) is shown in FIG. 3 wherein a sectional view of strut 14, as seen along line III—III of FIG. 1, is illustrated. As shown therein, this particularly embodiment employs a central core formed of balsa wood 41, surrounded by a composite layer 42 and provided with an exterior coating of rubber 43. The core of balsa wood 41 is employed for ensuring a light weight construction for the struts, while the composite layer adds tensile and compression strength, and the rubber coating provides a shock absorbing surface area for safety to the user and others that might come in contact with hydrofoil assembly 10 when in use. Different cores, various exemplary composites, and the preferred fabrication process, will be further explained hereinafter.

Figure 4:
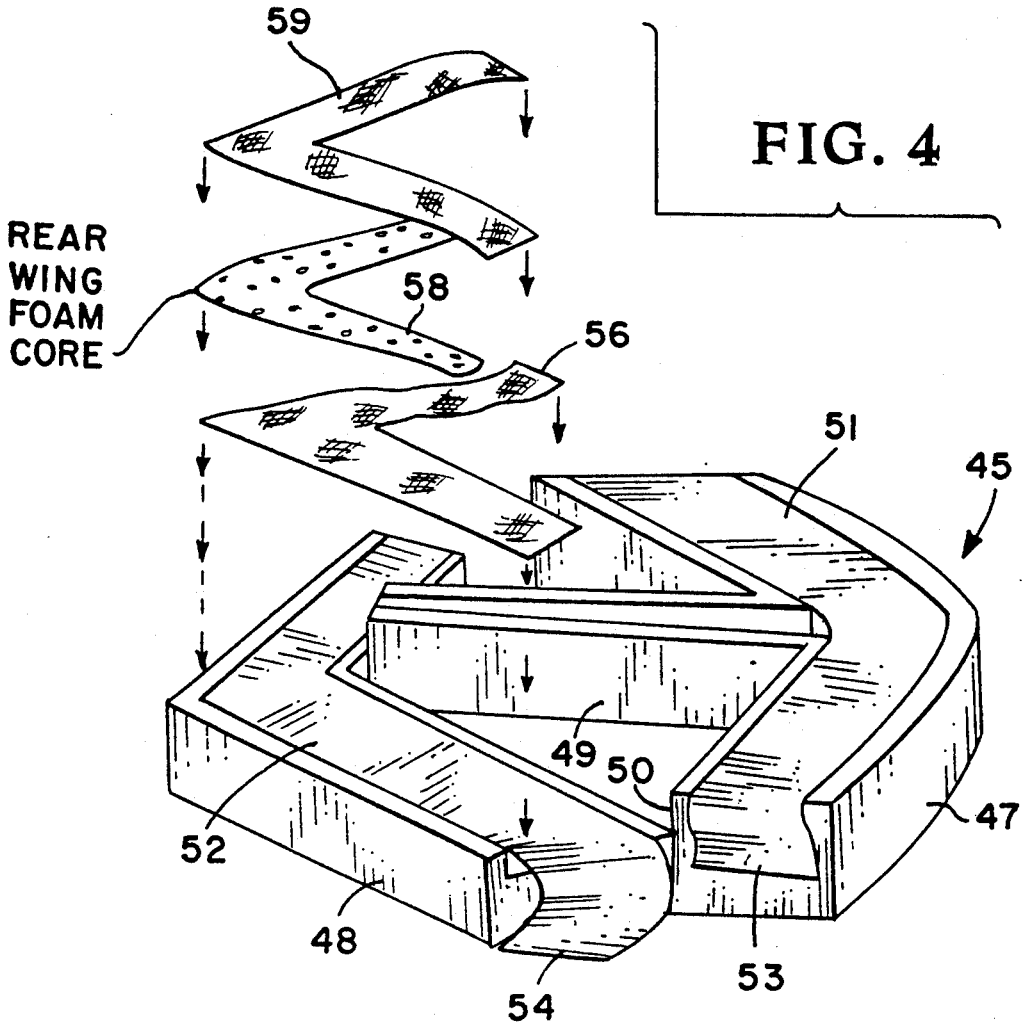
FIG. 4 is an exploded view of portions of the mold and some of the component parts employed in molding the hydrofoil structure shown in FIG. 2.

Referring now more particularly to FIG. 4, an exemplary mold assembly for fabricating hydrofoil 12 is shown, with parts of the mold and molding components being omitted for purposes of brevity and clarity. As shown therein, a base or bottom section 45 of a mold for constructing a hydrofoil 12 is illustrated. Mold 45 is provided with oppositely facing triangular sections 47,48 interconnected at the apexes thereof by a central rectangular section 49. Triangular sections 47,48 are disposed in parallel planes with the connected areas forming the spacing between the planes forming a mold area 50 (and one area not visible in this FIG.) for fabricating winglets 31,32.

Triangular sections 47,48 are lined with thin sheets of raw rubber, as designated by reference numerals 51,52. Central rectangular section 49 is also provided with a lining of thin strips of raw rubber that extend into mold cavities 47,48. Overlapping ends 53,54 of sheets 51,52 are disposed in mold area 50, and the other and oppositely disposed similar area (not shown). A first triangular layer of suitable prepreg material is then placed over each rubber lined cavity 47,48. One such layer of prepreg 56 is shown in FIG. 4 for mold cavity 48. Prepreg layer 56 is also of triangular configuration and provided with slightly less exterior width dimensions than the rubber lined cavity in mold section 48. The length of prepreg layer 56 extends beyond the rubber lined cavity and overlap with the overlapping rubber sheeting 54. A triangular planform foam core element 58, having exterior width dimensions slightly less than those of prepreg layer 56 is then positioned over prepreg layer 56. Foam core element 58 is provided with a relatively thick apex that is aerodynamically contoured to taper into the tapering trailing wing portions. A second triangular configured prepreg layer 59 is positioned over core element 58. Prepreg layer 59 has essentially the same exterior dimensions as those of prepreg layer 56. Additional strips of raw rubber (not shown), of similar dimensions as rubber strips 51, are then positioned over prepreg layer 59.

Mold cavity 47 is simultaneously filled, in identical fashion, and the description thereof is not further elaborated on here in the interest of brevity. Central rectangular section 49 is also provided with a layer of raw rubber with the ends of these layers of raw rubber extending into mold cavities 47,48. A rectangular foam core element (not shown) is sandwiched between layers of prepreg and placed in the rubber lined cavity 49, with a top layer of raw rubber sheet being then disposed thereover. After each of cavities 47,48 and 49 of bottom mold section 45 is filled, mold section 45 is closed with a mating cover mold section (not shown in the interest of brevity), and the contents therein heated to an elevated temperature to effect curing of the rubber and prepreg contents to form a unitary hydrofoil 12. After removing the cured product from mold section 45, the hydrofoil 12 is trimmed, cavity 36 and bores 37,38 cut therein and the hydrofoil 12 is ready for assembly to struts 14,15.

Figure 5:
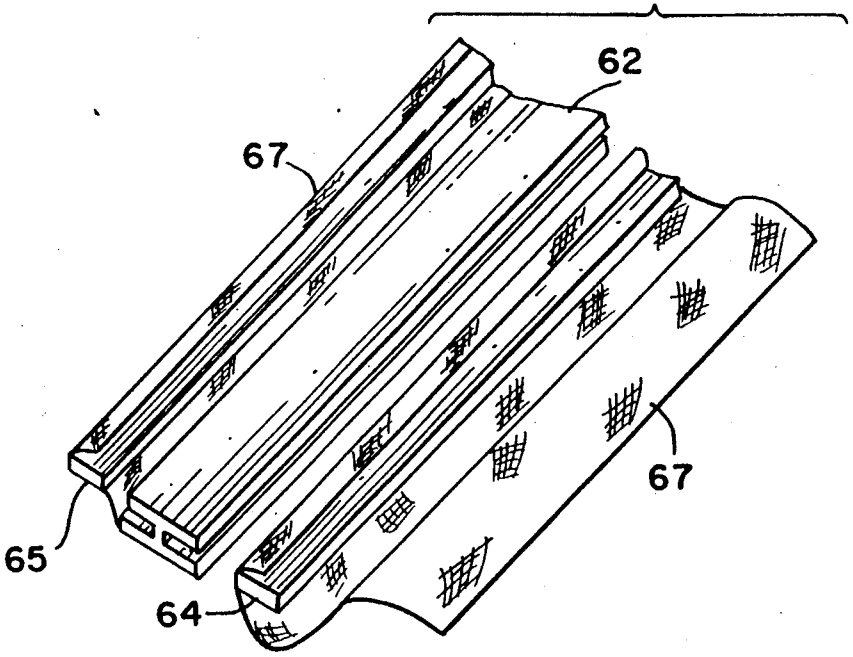
FIG. 5 is an exploded view of the component parts employed in constructing one core element for the strut and platform components.

Referring now more particularly to FIG. 5, one process for forming a core element for struts 14,15 will now be described. As shown therein, an elongated, thin I-beam of aluminum or aluminum alloy 62 is provided with a pair of elongated balsa wood strips 64,65 adapted to fill the open areas of I-beam 62. Prior to being positioned within the open areas of I-beam 62, balsa wood strips 64,65 are wrapped with at least one layer of prepreg material 67.

Figure 6:
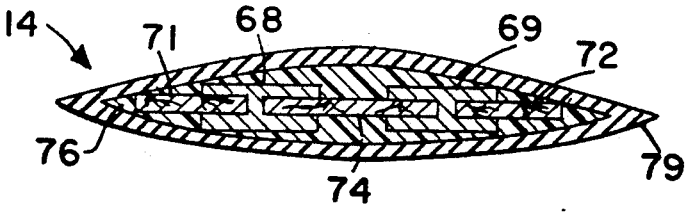
FIG. 6 is a sectional view similar to FIG. 3 illustrating one strut assembly having core elements as shown in FIG. 5.

FIG. 6 illustrates a sectional view of a strut 14 employing a pair of spaced aluminum I-beams 68 and 69, containing prepreg wrapped balsa wood strips 71,72 disposed in the exterior opening of respective I-beams 68,69. A common strip of prepreg wrapped balsa wood 74 extends between and is disposed within the facing openings of I-beams 68,69. The entire I-beam and balsa wood filler assembly is wrapped with a layer of prepreg material 76 and provided with a final coating layer of rubber 79 surrounding the entire strut structure. A final molding operation cures the prepreg and rubber into a unitary composite/rubber structure embedding the aluminum and balsa wood core therein, as will be described further hereinafter.

Figure 7:
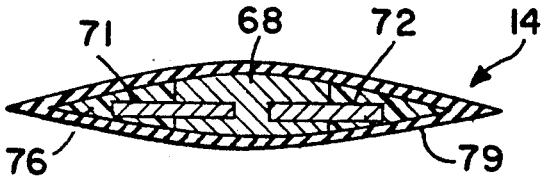
FIGS. 7, 8, 8*a* and 9 are sectional views similar to FIGS. 3 and 6 illustrating other struts employing other core elements.

FIG. 7 is a sectional view of another modification of a strut 14 wherein a single aluminum or aluminum alloy I-beam 68, having prepreg wrapped balsa wood strips 71,72 filling the openings in the I-beam, is employed as the core element for a strut. In this embodiment, as in the embodiment of FIG. 6, the entire core element is wrapped with further prepreg material 76 and provided with an exterior coating of rubber 79 before the final cure molding process.

Figure 8A:
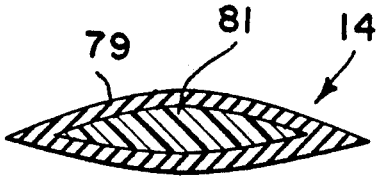
Figure 8:
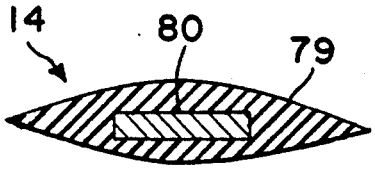

FIG. 8 illustrates another embodiment of a strut 14 wherein a solid aluminum or aluminum alloy core 80 is provided with an exterior aerodynamic coating of rubber 79.

FIG. 8*a* illustrates another embodiment of a strut 14 wherein a solid composite (cured resin-impregnated strands or fabric) core 81 is provided with an exterior aerodynamic coating of rubber 79.

Figure 9:
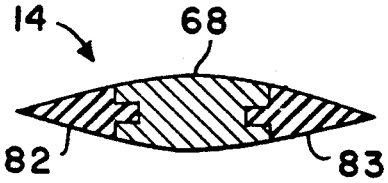

FIG. 9 is an illustration of another embodiment of a strut 14 wherein the leading and trailing edges only of an aluminum or aluminum alloy I-beam strut core element 86 is provided with aerodynamic rubber leading and trailing edges as designated, respectively, by reference numerals 82,83.

In addition to the embodiments shown and described in reference to FIGS. 3, and 6–9, the core for individual struts 14,15, as well as that for support support 17, may be in the form of three or more spaced, prepreg wrapped balsa wood filled, elongated aluminum or aluminum alloy I-beams, multiple solid or I-beam elongated aluminum or aluminum alloy beams, one or more solid, elongated, composite core elements, or spaced elongated balsa wood beams. In each embodiment, prepreg material may be employed to wrap the core element(s) prior to molding the rubber coating therearound or the core material may be provided with a rubber coating without employing the intermediate prepreg (composite) layer.

Figure 10:
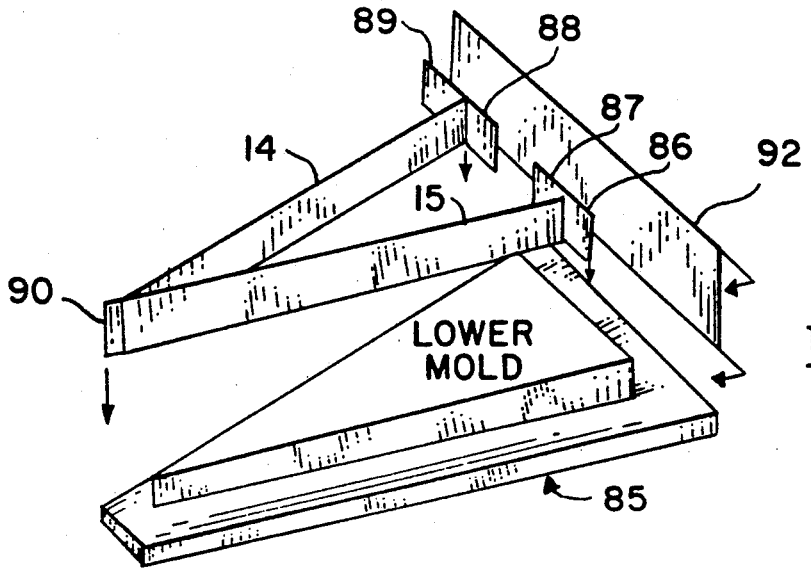
FIG. 10 is a schematic, exploded, perspective, representation of a portion of the mold assembly and parts employed to make a unitary strut and horizontal platform assembly.
Figure 11:
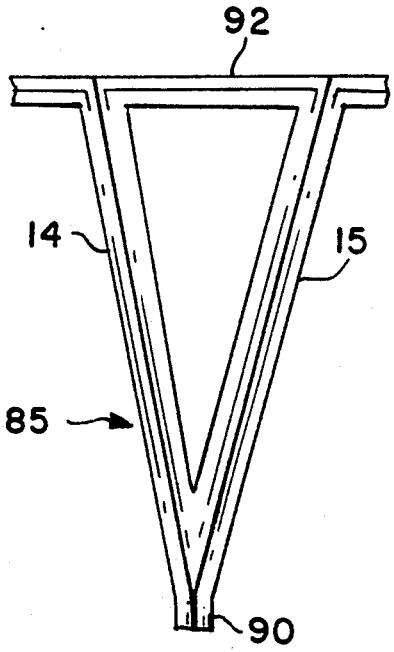
FIG. 11 is a top view of the mold assembly and parts shown in FIG. 8.

Referring now more particularly to FIGS. 10 and 11, the molding of the strut and platform portion of hydrofoil assembly 10 will now be described. Any of the core materials shown and described may be employed with the mold assembly, the lower or bottom portion of which is shown in FIGS. 10 and 11 and designated generally by reference numeral 85. Two lengths of the core material employed for making struts 14,15 are each sandwiched between two lengths of prepreg material and positioned in a V-configuration, as shown. The prepreg material is of adequate length to provide overlapping ends, as designated by reference numerals 86,87 and 88,89 for the excess length prepreg at the open end of the "V". The overlapping lengths of prepreg at the bottom of the "V" are disposed in abutting relationship, as designated by reference numeral 90.

Ends 86,87,88 and 89 are secured to a prepreg sandwiched platform core 92 by individual strips of prepreg (not shown) wrapped around core 92 and the respective ends 86,87,88 and 89 of the strut prepreg sandwiched strut cores. Additional strips of prepreg are added to the leading and trailing edges of the strut cores 14,15 with excess lengths thereof angularly extending along the bottom of platform core 92. An additional layer of prepreg material is employed to cover the entire surface of the attached strut and platform cores. The entire lay-up is then covered with raw or uncured rubber and loaded into mold section 85. A mating top mold section (not shown) is secured to mold section 85 and the closed mold heated to effect cure of the prepreg and rubber. After cooling to room temperature, holes are bored in section 90 for assembly via suitable bolts or spring pins to hydrofoil wing 12.

Figure 12:
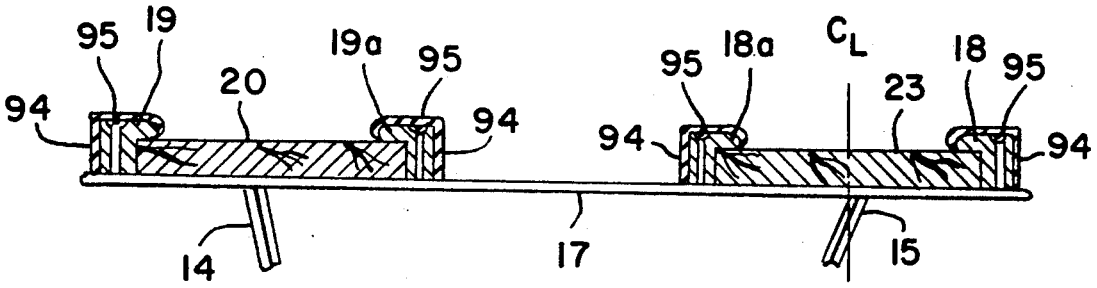
FIG. 12 is a part sectional view of the assembled struts and platform illustrating the attachments thereto for supporting a pair of water skis and a water skier, center loaded, over the hydrofoil wing.

Referring now to FIG. 12, a part sectional view of the assembled struts 14,15 and platform 17 is shown. As shown therein, struts 14,15 connect, respectively, to the bottom of platform 17 at substantially the mid-line thereof between ski support bracket pair 19,19*a* and bracket pair 18,18*a*. This center alignment for skis 20,23 ensures that the weight of the skier is "center loaded" onto struts 14,15 and center point loaded through struts 14,15 ($C_L$) onto hydrofoil wing 12. This construction permits lower stiffness requirements, and consequently, reduced weight, by permitting thinner contours for reducing drag on struts 14,15.

As also illustrated in this FIG., each member of the aluminum bracket pairs 18,18*a* and 19,19*a* is also provided with a rubber coating 94 to further avoid the existence of any sharp metal surfaces on hydrofoil assembly 10. Bracket pairs 18,18*a* and 19,19*a* are adjustably secured to platform 17 by screws 95 extending therethrough and engaging fastener elements (not shown) embedded in the base of platform 17. Three screws 95 (FIG. 1) are provided for each member of the bracket pairs.

Figure 13:
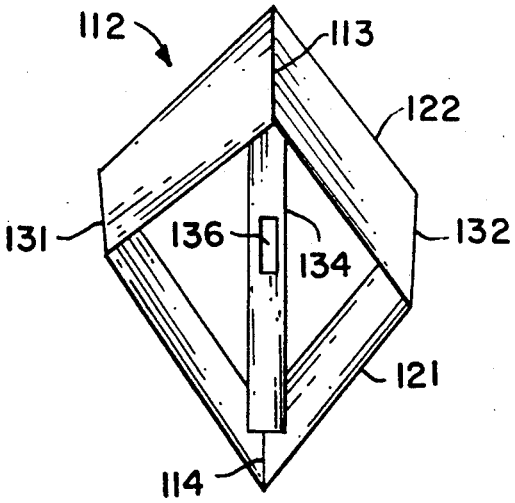
FIG. 13 is a top plan view of a modified core element employed to manufacture an alternate embodiment of the hydrofoil wing, according to the present invention.
Figure 14:
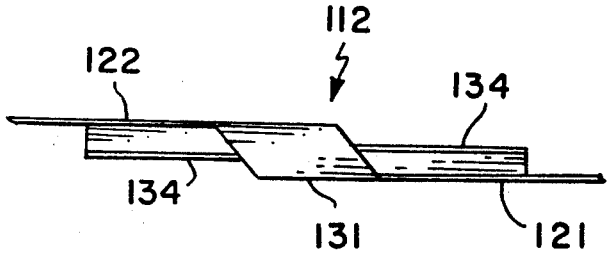
FIG. 14 is a side view of the core element shown in FIG. 13.

Referring now to FIGS. 13, and 14, a solid core element employed to manufacture an alternate embodiment of the present invention is illustrated and designated generally by reference numeral 112. Core element 112 may be formed of two inch wide, one-quarter inch thick, 6064 aluminum plate, bent to provide a pair of oppositely facing triangular planform, hydrofoil sections 121,122. Two identical lengths of bent aluminum plate are joined at the ends thereof, along lines 113 and 114, by suitable fastening plates (not shown) to provide the parallel planar, hydrofoil sections 121,122. Ninety degree winglet sections 131,132 (two inches in length or height) are formed intermediate the length of each bent aluminum plate, at the oppositely directed wingtips of hydrofoil sections 121,122. Core element 112 may also be formed of suitable prepreg tapes, laid-up or bent in the uncured state, to obtain the desired core structure and thermally cured into the rigid state.

The ends of elongated rectangular boom or spar 134 is connected to the opposing apexes of triangular planform hydrofoil sections 121,122. Spar 134 is formed of one-inch square aluminum tubing having a thickness of 0.0040 inch. A channel 136 is provided at substantially the center of spar 134 to receive the strut structure, as in the previously described embodiments. Although the dimensions are not critical, one specific core element 112 had a length of 24 inches (from apex tip to apex tip) and a width of 17 inches (from the oppositely disposed winglet portions).

Figure 15:
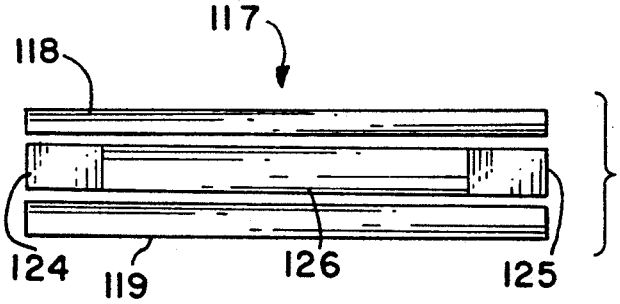
FIG. 15 is an exploded top plan view of an alternate platform/strut core embodiment of the present invention; and, FIG. 16 is an exploded perspective view of the strut core components employed in the platform/strut core element shown in FIG. 15.

Referring now to FIG. 15, an exploded view of the ski support platform core is shown and designated generally by reference numeral 117. Platform 117, as illustrated, is constructed of five component parts that include elongated side lengths 118, 119; bent ends 124, 125 of struts 114, 115 (FIG. 16) and a central portion 126 disposed between the ends of bent ends 124, 125, and all secured together, via suitable pop rivets or other conventional connectors, to form an essentially flush flat top surface for platform 117.

Figure 16:
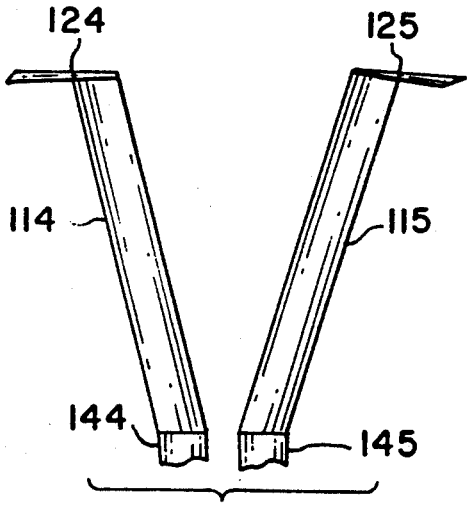

As shown in FIG. 16, strut elements 114, 115 are also provided with mating bent bottom portions 144, 145 that are adapted to be secured together and pin connected to spar 134 of hydrofoil wing 112.

Hydrofoil wing 112 and the connected platform/strut structures are provided with rubber coated, aerodynamic, exterior surfaces (FIG. 8) through a suitable injection molding process. Also, each of these components may also be placed in molds and provided with a layer or layers of prepreg, covered with raw rubber and oven heated to effect cure of the rubber and prepreg, if so desired.

The specific prepreg, rubber, foam core material, etc. employed in practice of the present invention may vary and any of these materials that will perform the results intended are considered within the scope of the present invention. The term "prepreg" is conventional in the art and is intended to include any pliable, resin impregnated, fiber or metal strands or fabric, available in tape or sheet form and employed to lay-up structures that are heat cured into solid composites. Fiberglass and graphite strands are the most frequently employed fiber or strands used in making prepreg.

A specific procedure employing specific materials for obtaining a preferred embodiment of the present invention will now be described but it is to be understood that these specific examples are to be deemed illustrative of the invention and are not exhaustive.

The raw rubber sheeting employed in the specific examples herein was natural rubber, uncured XP-3392, 1/16 inch thickness and available from J.D. Company, 3245 South Main Street, Fort Worth, TX. 76110. The aluminum "I" beam employed herein were cut from 2024/.040 inch sidewall; 0.25 inch thick by 1.00 inch wide by 36 inch length and available from McMaster-Carr Supply Company, P.O. Box 440, New Brunswick, N.J. 08903-0440. The balsa wood strips were cut from 4 to 6 pound square/foot balsa wood stock. The prepreg materials and adhesive utilized in the specific examples herein were obtained from ICI FIBERITE, 2055 East Technology Circle, Temple, AZ 85284 and included:

(#1) Fiberite 322/7714AC Graphite, 0.010"
(#2) Fiberite MXB7701/120 Fiber Glass, 0.004"
(#3) Fiberite 9148A1B, Unidirectional Fiber Glass, 0.004"
(#4) Fiberite 176/7714A Graphite, 0.0055"
(#5) Fiberite HYE 91714 AB Type Graphite, 0.0055"

The adhesive employed was Hysol 9628 Film Adhesive, 0.045 lbs/sq ft.

Two panels of prepreg material were fabricated from these components for use in the specific embodiments described herein.

A first panel (Panel No. 1) was 20" W (wide) by 44" L (long) by 0.032" T (thick) and was formed of stacked fiberglass (FG) sheets:

| Quantity and Material # | Thickness | Fiber Orientation |
|---|---|---|
| three pieces Uni-FG (#3) | .004" | 0 |
| one piece FG (#2) | .004" | ±45° |
| three pieces FG (#2) | .004" | 0-90° |
| 1 piece FG (#2) | .004" | ±45° |

A second panel (Panel No. 2) was 20" W by 44" L by 0.036 T formed of stacked graphite sheets:

| Quantity and Material # | Thickness | Fiber Orientation |
|---|---|---|
| 1 pice graphite (#1) | .010" | 0-90° |
| 1 piece graphite (#4) | .0055" | 0-90° |
| 3 pieces Uni-graphite (#5) | .0055" | 0 |
| 1 piece graphite (#4) | .0055" | 0-90° |

The following cuts were made from Panel No. 1 and each cut labeled as indicated:

| Number of cuts | Dimensions | Labeled |
|---|---|---|
| Four (4) pieces | 2.25" W by 44" L | A-1 |
| Four (4) pieces | .250" W by 44" L | C-1 |
| Two (2) pieces | 4.25" W by 22" L | D-1 |

The following cuts were made from Panel No. 2 and each cut labeled as indicated:

| Number of cuts | Dimensions | Labeled |
|---|---|---|
| Four (4) pieces | .50" W by 44" L | B-2 |
| Four (4) pieces | 2.50" W by 44" L | E-2 |
| One (1) piece | 4.50" W by 22" L | F-2 |
| One (1) piece | 4.50" W by 18" L | G-2 |
| Two (2) pieces | 4.50" W by 2" L | H-2 |
| Two (2) pieces | .50" W by 40" L | I-2 |
| Two (2) pieces | .50" W by 44" L | J-2 |

Four (4) pieces of balsa wood 0.0180" T by 0.750" W by 36" L were cut from stock for constructing strut sections 14,15 and four (4) pieces 0.180" T by 0.750" W by 22" L were cut from stock for constructing the ski support platform 17.

Two pieces of aluminum "I" beam 0.250" T by 1" W by 36" L were cut for constructing each of strut sections 14, 15 and one piece of aluminum "I" beam 0.250" T by 22" L cut for constructing support platform 17.

All aluminum pieces were solvent cleaned (with toluene) and provided with a layer of Hysol 9628 film adhesive on the one inch exterior surfaces. All molds employed are provided with a coating of a suitable release agent such as Mono-Coat (available from CHEM-TREND, Inc., 3205 E. Grand River, Howell, Mich. 48843) and baked at 225 degrees F for twenty minutes.

For constructing the core assembly for struts 14 and 15, each of the four (0.180" T by 0.750" W by 36" L) pieces of balsa wood are wrapped with a layer of prepreg 120 style fiberglass (Fiberite MXB7701/120 Fiber Glass, 0–90 degrees) using "77-Spray Adhesive" on both the balsa wood and one side of the fiberglass sheet. "77-Spray Adhesive" is available from 3M Industrial Adhesive Systems, St. Paul, MN 55144-1000. A 0.100" overlap of the fiberglass sheet is employed. These fiberglass wrapped balsa wood pieces are installed in the 36" aluminum I-beam sections for both struts 14 and 15, as illustrated in FIG. 5.

Strips (0.500" W by 5.0" L) of Fiberite 9148A1B Unidirectional Fiber Glass, 0.004" T, are wrapped around each of the two balsa wood/I-beam sections at three spaced locations to keep the strut straight core lay-ups together.

For assembly of horizontal platform core assembly, one layer of prepreg 120 style fiberglass, (Fiberite MXB7701/120 Fiber Glass, 0–90 degrees) is wrapped around each of the three 0.180" T by 0.750" W by 22" L balsa wood pieces, using 77-Spray Adhesive on the balsa wood and on one side of the fiberglass, with an overlap of 0.100" fiberglass being provided. These three fiberglass wrapped balsa wood strips are installed in the two 0.250" T by 1" W by 22" L aluminum I-beam sections with one balsa wood strip having an edge disposed in each I-beam section. Three spaced strips (0.500" W) of the Fiberite 9148A1B Unidirectional Fiber Glass are wrapped at spaced intervals along the balsa wood/I-beam sections to keep the platform core lay-up together.

One piece cut from Panel No. 1 (labeled "A-1") is sandwiched between each two pieces of Panel No. 2 (labeled "B-2) to form four separate prepreg pieces. The core lay-ups are each sandwiched between two of these combined prepreg pieces. The sandwiched straight strut core lay-ups are centered, from side-to-side, and placed six inches from one end of this sandwich and two inches from the other end. One Panel No. 1 piece (labeled C-1) is added onto each side of the straight strut core lay-up sandwich.

The horizontal platform core lay-up is sandwiched between two Panel No. 1 pieces (labeled D-1) and positioned within mold section 85 against overlapping prepreg 86,87 and 88,89 as shown in FIGS. 10 and 11. A strip of 0.500" W by 30" L Fiberite 9148A1B, Unidirectional Fiber Glass is wrapped around each overlapping portion 86,87 and 88,89 and the abutting prepreg sandwiched platform to retain the components in position during thermal cure. Five additional strips of the uni-fiberglass (0.500 W by 30" L) are added to the leading and trailing straight edges of the straight strut core sections, in staggered inward, with the excess lengths fanning out across the bottom of the horizontal platform 92 (FIG. 11).

Four Panel No. 2 pieces (labeled E-2) are applied to the inside and outside of the straight strut lay-up sections with the additional lengths thereof extending across the bottom of horizontal platform 92. One piece of uni-fiberglass 0.500" W by 30" L is added to each side of the straight sections 14, 15 (FIG. 10). One Panel No. 2 piece (labeled F-2) is added to the top side of horizontal platform 92; one Panel No. 2 piece (labeled (G-2) added to the bottom of platform 92 between the contacting strut ends; two Panel No. 2 pieces (labeled H-2) added to the bottom of platform 92 outside of the strut contact ends; one Panel No. 2 piece (labeled I-2) is applied to the outside length of each strut lay-up; and, one Panel No. 2 piece (labeled J-2) is applied to the inside length of the V-configured lay-up.

The entire strut and platform lay-up is then covered with raw rubber strips (Natural rubber, uncured XZP-3392, 1/16" thick) and loaded into mold section 85. A mating top cover (not shown) for mold section 85 is then installed and secured by pins, bolts and clamps to mold section 85. The closed mold is oven heated to 180 degrees F, all pins, bolts and clamps again tightened; heated to and maintained at 200 degrees F for thirty minutes; and, finally heated to and maintained at 250 degrees for two hours to effect final cure of the rubber and composite prepreg. After cooling to room temperature, the cured product is removed from the mold, deflashed or trimmed, and holes 37,38 (FIG bored in section 90 for assembly, via suitable bolts or spring pins 37,38 (FIG. 1), to hydrofoil wing 12.

In addition to the Panel No. 1 and Panel No. 2 prepreg employed in molding the strut and platform assembly, polyurethane foam is employed to form the core for molding one specific embodiment of hydrofoil wing 12. The polyurethane foam employed in the specific example described herein was "Stathane Foam 6506 System with Micro Balloons" and available from Expanded Rubber and Plastics Corp., 14000 S. Western Ave., Gardena, Calif. 90249. Core molds (not shown) were made to produce two aerodynamically contoured wing core elements 58 (FIG. 4) and a rectangular boom core element (not shown). In each operation 80 grams of the Stathane Foam (40 grams Part A and 40 grams Part B) were mixed and poured into the respective mold cavities. The molds were then closed and heated to 120 degrees F for thirty minutes to effect cure of the foam plastic. The cores were then removed from the molds, solvent (toluene) cleaned and air dried for two hours (or oven dried for thirty minutes at 110 degrees F)

Suitable templates (not shown) are provided for cutting the panel materials employed in the molding process as follows:

Wind Prepreg Material List

| Number of Pieces | Template | Source | Labeled |
|---|---|---|---|
| Four (4) | Panel No. 1 | A | W-A1 |
| Four (4) | Panel No. 1 | B | W-B1 |
| Four (4) | Panel No. 2 | C | W-C2 |
| Four (4) | Panel No. 2 | D | W-D2 |

Boom Prepreg Material List

| Number of Pieces | Source | Template | Labeled |
|---|---|---|---|
| Two (2) | Panel No. 1 | E | B-E1 |
| Two (2) | Panel No. 1 | F | B-F1 |

| Rubber Material List for Wing and Boom (all pieces cut from raw rubber roll 1/16" Thick) | | |
|---|---|---|
| Number of Pieces | Template | Labeled |
| One (1) | G | R-G-F |
| One (1) | H | R-H-AFT |
| One (1) | I | R-I-LB |
| One (1) | J | R-J-UB |
| One (1) | K | R-K-AFT |
| One (1) | L | R-L-F |
| One (1) | M | R-M-B |

Rubber pieces R-G-F and R-H-AFT are installed in the wing areas of mold section 45 shown in FIG. 4 and piece R-I-LB installed in the boom section of the mold. An excess length of each rubber piece is provided to drape over the ends of the mold as designated by reference numerals 53,54. Two Panel No. 1 pieces (labeled W-A1) are sandwiched around the pre-fabricated foam core 58 and the centered core placed in triangular mold section 48.

One Panel No. 1 piece (B-E1) is wrapped around the upper side of the pre-fab boom core (not shown) and one Panel No. 1 piece (B-F10) is wrapped around the lower side of the boom core.

Two Panel No. 1 pieces (W-B1) are wrapped around the other pre-fabed triangular foam core (not illustrated), again centering the planform of both the foam core and prepreg panels. The prepreg wrapped forward wing core is placed in triangular mold section 47. Two Panel No. 2 pieces (W-C2) are located, one each, on the upper and lower portions of this wing and two Panel No. 2 sections (labeled W-D2) are located, one each, on the respective upper and lower portions of the wrapped wing core in model cavity 48.

The remaining boom pieces (B-E1 and B-E2) are then installed on the respective upper and lower sides of the prepreg wrapped boom. After the entire assembly is disposed in bottom mold section 45, the overlapping rubber and prepreg segments are folded in flip-flop orientation (upper, lower, upper then lower) to the winglet area of the mold and secured in position. The remaining rubber panels (R-J-UB and R-M-B) are added to cover the boom mold area and the mold sealed by an upper mold cover (not shown).

The upper mold cover is bolted and clamped to bottom mold section 45 in a conventional manner. The closed mold is then oven heated to 180 degrees F., the bolts again tightened, followed by again heating and maintaining the mold temperature at 200 degrees F. for thirty minutes, followed by heating and maintaining the mold assembly at 250 degrees F. for two hours, to effect final cure of the rubber and prepreg composite layers.

After cooling to room temperature, the hydrofoil wing 12 is removed from the mold, placed in a routering fixture and slot 34 router cut therein prior to drilling two 3/16" holes (37,38 FIG. 2) transversely therethrough.

The end 90 of the prefab strut, as described hereinbefore, is then inserted into slot 34 and the assembly secured together via spring pins 39,40 embedded in 2216 Epoxy to lock the pins in place.

Although the invention has been described relative to specific embodiments thereof, it is not so limited, and there are numerous variations and modifications thereof that will be readily apparent to those skilled in the art in the light of the above teachings. For example, the specific prepreg materials employed may be varied and are not confined to those described relative to the specific examples. A combination of fiberglass and graphite fiber prepregs were employed herein to utilize the stiffness and flexibility of these materials at specific areas in the process but the successful operation of the invention is not necessarily dependent upon use of these specific materials. Also, the foam core material for the wing and boom portions may be made from other materials such as balsa wood, aluminum, aluminum alloy plating, I-beams, solid or honeycomb, as well as composites, without departing from the spirit and scope of the invention.

Further, although specific dimensions for various components of the invention have been recited for some of the specific examples exemplified herein, these too, are not considered critical and any size hydrofoil wing, V-strut, and horizontal platform combination, that performs the purposes intended are considered within the scope of the appended claims.

It is therefore to be understood that, within the scope of the appended claims, the invention may be practiced other than as specifically described herein.

I claim:

1. A water ski hydrofoil comprising:

a pair of hydrofoil sections;

each member of said pair of hydrofoil sections having an apex and a pair of wings integral with said apex and trailing in angular relationship therefrom to form an open base triangular planform;

each member of said pair of wings on each said open base triangular planform sections being provided with wing tips;

each said wing tip being provided with a ninety degree vertical winglet section extending therefrom;

said open base triangular planform hydrofoil sections facing in opposite directions and disposed in separate parallel planes such that said winglets on one hydrofoil abut the winglets on the other hydrofoil;

said ninety degree vertical section winglets of said one hydrofoil section being connected to said ninety degree vertical section winglets of said other hydrofoil section to thereby form an open diamond shaped planform structure; and said open diamond shaped planform structure including an elongated spar having one end thereof connected to each said apex of said open base triangular planform hydrofoil sections.

2. The water ski hydrofoil of claim 1 including a shock absorbing rubber exterior surface coating provided on at least the leading and trailing edges of said diamond shaped planform structure.

3. The water ski hydrofoil of claim 1 including a pair of elongated struts;

each of said struts having one end thereof secured to substantially the intermediate length of said spar;

an elongated ski support platform structure having a base surface and a top surface and disposed in parallel spaced relationship to said spar;

said struts angularly extending from said spar in a V-configuration and having the other ends thereof secured in spaced relationship to said base surface of an elongated ski support platform structure; and water ski retention means disposed on said top surface of said ski support structure for releasably retaining a pair of water skis center line loaded thereon.

4. The water ski hydrofoil of claim 3 wherein at least the leading and trailing edges of said elongated ski support platform structure and said pair of struts are provided with an exterior surface coating of shock absorbing rubber.

5. The water ski hydrofoil of claim 3 wherein said struts are provided with an interior core, an intermediate composite layer surrounding said interior core and a shock absorbing rubber exterior surface coating.

6. The water ski hydrofoil of claim 5 wherein said interior core is selected from the group of core materials consisting of aluminum, aluminum alloys, composites and balsa wood.

7. The water ski hydrofoil of claim 6 wherein said aluminum, aluminum alloy, composites and balsa wood core materials are selected from the group of core material elements consisting of single unitary core elements and multiple spaced core elements.

8. The water ski hydrofoil of claim 3 wherein said diamond shaped planform structure, said struts and said elongated ski support platform structure are all provided with a shock absorbing exterior rubber surface.

9. The water ski hydrofoil of claim 1 wherein each of said pair of hydrofoil sections and said spar are provided with an interior core element, an intermediate composite layer surrounding said interior core element and an exterior surface layer of shock absorbing rubber.

10. The water ski hydrofoil of claim 9 wherein said interior core element is selected from the group of core materials consisting of aluminum, aluminum alloys, polyurethane foamed plastic, composites and balsa wood.

11. The water ski hydrofoil of claim 9 wherein said intermediate composite layer is selected from the group of composite materials consisting of fiberglass-resin and graphite-resin composites.

12. The water ski hydrofoil of claim 9 wherein said winglet sections are formed of rubber, fiberglass-resin and graphite-resin composites.

13. A molded, lightweight, high strength, water ski hydrofoil assembly comprising:

a diamond planform hydrofoil wing including two identical triangular planform hydrofoil sections disposed in parallel planes and facing in opposite directions;

each said hydrofoil section having an apex and a pair of angular trailing wings;

each of said angular trailing wings having wing tips terminating in ninety degree vertical winglet sections;

said winglet sections on one said hydrofoil section connected to said winglet sections on the other of said hydrofoil sections to form a pair of winglets on said diamond planform hydrofoil wing;

an elongated spar integrally formed between and in connection with said apexes of said triangular planform sections;

a pair of elongated strut elements attached to said spar intermediate the length thereof;

said pair of strut elements being disposed in a V-configuration having a closed base portion and an open end portion;

said closed base portion of said V-configuration being attached to said spar and said open end of said V-configuration vertically extending therefrom;

a ski support platform secured to said open end of said V-configuration and disposed in a parallel plane relative to said diamond planform hydrofoil wing;

said ski support platform having adjustable ski retention brackets thereon to retain a pair of water skis and provide support for a skier; and a shock absorbing rubber coating disposed on at least the leading and trailing edge surfaces of said diamond planform hydrofoil wing, said pair of strut elements and said ski support platform.

14. A method of making an improved water ski hydrofoil system comprising:

providing a unitary lightweight, high strength, hydrofoil wing in a diamond planform configuration and formed of a pair of triangular planform hydrofoil sections facing in opposite directions and disposed in spaced parallel planes;

providing ninety degree winglet sections on the ends of each triangular section and secured together to maintain the planar spacing between the pair of triangular hydrofoil sections;

securing a unitary spar to, and disposed between, the apexes of the pair of triangular hydrofoil sections;

forming a channel intermediate the length of the spar;

forming a pair of elongated strut elements disposed in a V-configuration;

positioning and attaching the base of the V-configured struts within the spar channel;

providing a ski support platform secured to the open end of the V-configured struts and disposed parallel with the diamond planform hydrofoil wing;

providing adjustable brackets on the top surface of the platform to support a pair of water skis such that the weight of a skier using the skis is center-point loaded through the V-configured struts, onto the hydrofoil wing; and, providing a shock absorbing rubber surface on at least the leading and trailing edge surfaces of the hydrofoil wing, V-struts, and ski support platform.

15. The method of making an improved water ski hydrofoil system as in claim 14 including the steps of:

providing a triangular foam plastic core element for each of the triangular planform sections;

applying at least one layer of a prepreg material over each foam plastic core;

applying at least one layer of raw rubber over each of the prepreg covered foam plastic cores; and heat curing the prepreg and rubber in an elevated temperature mold to effect curing of the prepreg and rubber into a composite/rubber laminate coating for the foam plastic cores.

16. The method of making an improved water ski hydrofoil system as in claim 15 including the steps of:

forming the ninety degree winglet sections by employing overlapping end lengths of the prepreg material and raw rubber extending beyond the ends of the triangular foam plastic core, positioning the overlapped end lengths of prepreg and rubber in alternate arrangement and in ninety degree relationship relative to the triangular planform sections; and heat curing the alternately arranged prepreg and rubber end lengths in the elevated temperature mold into unitary winglets simultaneously with curing of the coating on the foam plastic core.

17. The method of making an improved water ski hydrofoil system as in claim 14 wherein the step of forming a pair of elongated strut elements disposed in a V-configuration includes the steps of:

providing an at least one elongated core element for each of the struts;

encompassing each of the core elements with at least one layer of a prepreg material;

providing a raw rubber sheet layer over the prepreg encompassed strut core elements; and heat curing the prepreg and rubber into an intermediate layer of composite and an exterior surface layer of shock absorbing rubber on the strut elements.

18. The method of claim 17 wherein the step of providing a ski support platform secured to the open end of the V-configured struts and disposed parallel with the diamond planform hydrofoil wing includes the steps of:

providing at least one elongated platform core element for the ski support platform;

encompassing the at least one elongated platform core element with at least one layer of a prepreg material;

securing the prepreg encompassed platform core element to the open ends of the prepreg encompassed V-configured strut core elements;

positioning the secured prepreg encompassed platform core element and the prepreg encompassed V-configured strut core elements into a rubber lined mold;

providing a raw rubber sheet layer over the prepreg encompassed platform core element before closing and sealing the mold; and elevating the temperature of the mold to effect the heat curing of the prepreg and rubber into an intermediate layer of composite and an exterior surface layer of shock absorbing rubber on both the strut elements and the ski support platform.

19. The method of claim 14 wherein the step of providing adjustable brackets on the top surface of the platform includes securing a pair of spaced brackets adjacent each end of the platform top surface via a plurality of adjustable screws and providing a shock absorbing coating on each one of said brackets.

20. The method of claim 14 wherein each of the diamond planform hydrofoil wing, the attached V-configured strut elements, and the ski support platform secured to the open ends thereof, are provided with interconnecting core elements selected from the group of core elements consisting of composite materials and aluminum or aluminum alloy materials.

* * * * *